US011585620B2

(12) United States Patent
Raley et al.

(10) Patent No.: US 11,585,620 B2
(45) Date of Patent: Feb. 21, 2023

(54) MOUNT FOR A FIREARM

(71) Applicant: ZRODELTA, LLC, Connelly Springs, NC (US)

(72) Inventors: Timothy Wayne Raley, Hickory, NC (US); Aaron A. McGinty, Statesville, NC (US)

(73) Assignee: ZRODELTA, LLC, Connelly Springs, NC (US)

( * ) Notice: Subject to any disclaimer, the term of this patent is extended or adjusted under 35 U.S.C. 154(b) by 0 days.

(21) Appl. No.: 17/147,758

(22) Filed: Jan. 13, 2021

(65) Prior Publication Data

US 2022/0042772 A1 Feb. 10, 2022

Related U.S. Application Data

(60) Provisional application No. 63/063,412, filed on Aug. 9, 2020.

(51) Int. Cl.

| | |
|---|---|
| ***F41A 19/15*** | (2006.01) |
| ***F41A 19/43*** | (2006.01) |
| ***F41G 11/00*** | (2006.01) |

(52) U.S. Cl.

CPC ..... *F41A 19/15* (2013.01); *F41A 19/43* (2013.01); *F41G 11/003* (2013.01)

(58) Field of Classification Search

CPC ..... F41G 11/003

See application file for complete search history.

(56) References Cited

U.S. PATENT DOCUMENTS

| | | | | | |
|---|---|---|---|---|---|
| 1,899,249 | A * | 2/1933 | Walliser | F41G 11/004 | 248/231.31 |
| 3,877,166 | A * | 4/1975 | Ward | F41G 11/003 | 42/127 |
| 4,209,157 | A * | 6/1980 | Edmisten | F41C 33/00 | 248/691 |
| 4,505,012 | A * | 3/1985 | Johnson | F41C 23/02 | 24/643 |
| 4,841,658 | A * | 6/1989 | Katsenes | F41C 23/02 | 42/85 |
| 4,924,615 | A * | 5/1990 | Ives | F41C 23/02 | 24/2.5 |
| 5,067,267 | A * | 11/1991 | Ives | F41C 23/02 | 24/2.5 |
| 5,155,915 | A * | 10/1992 | Repa | F41G 11/003 | 42/129 |
| 5,680,725 | A * | 10/1997 | Bell | F41G 11/003 | 42/127 |

(Continued)

*Primary Examiner* — Michelle Clement

(74) *Attorney, Agent, or Firm* — Bennet K. Langlotz; Langlotz Patent & Trademark Works, LLC

(57) ABSTRACT

A mount for a firearm has a body having a first clamp configured to engage a first edge of the rail, a jaw movably connected to the body and having a second clamp opposed to the first clamp and operable with the respective clamps to engage respective opposed lateral edges of the rail, a spring biasing the jaw toward the body, and at least a portion of the spring being between the clamps. There may be a pushrod connected to a first one of the body and the jaw and slidably received by the other of the body and the jaw. The spring may be laterally positioned to one side of the pushrod. The spring may be a coil spring having a spring axis offset from a pushrod axis defined by the pushrod.

18 Claims, 6 Drawing Sheets

(56) References Cited

U.S. PATENT DOCUMENTS 6,449,893 B2 * 9/2002 Spinner ..... F41G 11/003 42/126
6,637,144 B2 * 10/2003 Nelson ..... F41G 1/35 42/120
7,107,716 B1 * 9/2006 Liao ..... F41C 27/00 42/108
7,562,485 B2 * 7/2009 Newhall ..... F41G 11/003 42/127
7,654,028 B1 * 2/2010 Grover ..... F41C 23/02 24/2.5
8,132,355 B1 * 3/2012 Kincaid ..... F41G 1/35 403/374.5
8,276,307 B2 * 10/2012 Deros ..... F41G 11/003 42/127
8,336,247 B2 * 12/2012 Haering ..... F41G 11/003 42/111
8,393,105 B1 * 3/2013 Thummel ..... F41G 11/003 42/127
8,438,965 B2 * 5/2013 Collin ..... F41G 11/003 89/125
8,567,105 B1 * 10/2013 Bobro ..... F41G 11/003 42/127
8,806,796 B1 * 8/2014 Clifton ..... F41G 11/003 42/127
8,813,412 B2 * 8/2014 Rorick ..... F41C 27/00 248/689
9,297,616 B2 * 3/2016 Daniel ..... F41G 11/004
9,568,281 B1 * 2/2017 Chen ..... F41G 11/003
9,671,198 B2 * 6/2017 Bartoszewicz ..... F41G 11/003
10,024,632 B1 * 7/2018 Oglesby ..... F41G 11/003
10,036,614 B1 * 7/2018 Ruiz ..... F41G 11/003
10,132,596 B2 * 11/2018 Bartoszewicz ..... F41G 11/003
10,219,589 B1 * 3/2019 Lin ..... F16G 15/06
10,619,977 B2 * 4/2020 Silvennoinen ..... F41G 11/003
10,895,436 B2 * 1/2021 Ross ..... F41G 11/004
11,105,586 B2 * 8/2021 Tayon ..... F41G 11/003
2006/0117636 A1 * 6/2006 Newhall ..... F41G 11/003 42/124
2008/0168696 A1 * 7/2008 Orne ..... F41G 11/003 42/90
2010/0229448 A1 * 9/2010 Houde-Walter ..... F41G 1/35 42/114
2011/0058362 A1 * 3/2011 Sun ..... F41G 1/35 362/187
2011/0067287 A1 * 3/2011 Collin ..... F41G 11/003 42/90
2011/0146128 A1 * 6/2011 Haering ..... F41G 11/003 42/90
2011/0167703 A1 * 7/2011 Deros ..... F41G 11/003 42/90
2011/0247255 A1 * 10/2011 Ding ..... F41G 11/003 42/90
2012/0167438 A1 * 7/2012 Daniel ..... F41G 11/004 29/525.08
2012/0198745 A1 * 8/2012 Riley ..... F41C 27/00 42/90
2013/0156495 A1 * 6/2013 Li ..... F16B 2/12 403/322.4
2013/0312307 A1 * 11/2013 Rorick ..... F41G 11/003 42/90
2013/0312309 A1 * 11/2013 Rorick ..... F41G 11/003 42/114
2014/0137457 A1 * 5/2014 Collin ..... F41G 11/003 42/90
2014/0196348 A1 * 7/2014 Samson ..... F41C 27/00 42/90
2014/0252187 A1 * 9/2014 Petrovic ..... F16B 2/185 248/229.16
2014/0305021 A1 * 10/2014 Prieto ..... F41G 11/003 42/111
2015/0068095 A1 * 3/2015 Collin ..... F41G 11/003 42/90
2015/0159847 A1 * 6/2015 Galli ..... F41G 1/36 362/111
2015/0362291 A1 * 12/2015 Samson ..... F41G 11/004 29/428
2016/0202022 A1 * 7/2016 Gao ..... F41G 11/004 42/90
2017/0045334 A1 * 2/2017 Yim ..... F16M 11/041
2018/0259298 A1 * 9/2018 Gao ..... F16B 2/18
2018/0292169 A1 * 10/2018 Toiler ..... F41G 1/35
2018/0340754 A1 * 11/2018 Cosentino ..... F41G 11/003
2018/0340755 A1 * 11/2018 Cosentino ..... F41G 11/003
2018/0347950 A1 * 12/2018 Swan ..... F41G 11/003
2019/0128470 A1 * 5/2019 Johnson, Sr. ..... F41G 11/00
2019/0219365 A1 * 7/2019 Ma ..... F41G 11/003
2019/0234710 A1 * 8/2019 Batenhorst ..... F41G 11/004
2019/0242677 A1 * 8/2019 Ding ..... F41G 11/003
2019/0249696 A1 * 8/2019 Larue ..... F41G 11/003
2019/0285386 A1 * 9/2019 Burt ..... F41G 1/38
2020/0011642 A1 * 1/2020 Ma ..... F41G 11/004
2020/0025522 A1 * 1/2020 Zimmer ..... F41G 11/001
2020/0200508 A1 * 6/2020 Teetzel ..... F41G 1/36
2021/0140743 A1 * 5/2021 Chen ..... F41G 11/003
2022/0163292 A1 * 5/2022 Kilic ..... F41G 11/003

* cited by examiner

MOUNT FOR A FIREARM

CROSS-REFERENCE TO RELATED APPLICATION

This application claims the benefit of U.S. Provisional Patent Application No. 63/063,412 filed on Aug. 9, 2020, entitled "Universal Fire Control, Rechargeable, Global Positioning and Alert Communication, Mount Adapter Utilizing Push System with Offset Springs, Mid-Receiver Carbine, and Ambi-Magazine Release," which is hereby incorporated by reference in its entirety for all that is taught and disclosed therein.

FIELD OF THE INVENTION

The present invention relates to firearms, and more particularly to a mount for a firearm that enables the mount to be easily attached to and detached from a firearm.

BACKGROUND AND SUMMARY OF THE INVENTION

Many designs exist for mounting accessories to universal weapon accessory rails such as the NATO STANAG 4694 accessory rail. Methods of attachment include screws, levers, and knobs. One example of a prior art of such a design is the mount adapter device utilizing a push system disclosed in U.S. Pat. No. 8,276,307 to Deros, which is hereby incorporated by reference in its entirety for all that is taught and disclosed therein. The design of the '307 patent applies a spring-loaded force as part of the clamping mechanism to aid in holding the accessory on the rail. The key elements of the design are a main body, a lock bar, a connecting push rod, and a spring received around the push rod. The spring applies a biasing force along the longitudinal axis of the push rod against a knob attached to one end of the push rod that pulls the lock bar towards the main body, thereby creating a clamping force between the lock bar and the main body around the rail.

The '307 patent has the disadvantage of requiring a knob that protrudes substantially from the main body to provide space for the compressed spring received around the push rod. This requirement makes the mount adapter device more likely to snag undesirably on items in the environment.

Therefore, a need exists for a new and improved mount for a firearm that has knobs with limited protrusion from the main body to prevent undesirable snagging on items in the environment. In this regard, the various embodiments of the present invention substantially fulfill at least some of these needs. In this respect, the mount for a firearm according to the present invention substantially departs from the conventional concepts and designs of the prior art, and in doing so provides an apparatus primarily developed for the purpose of preventing undesirable snagging on items in the environment.

The present invention provides an improved mount for a firearm, and overcomes the above-mentioned disadvantages and drawbacks of the prior art. As such, the general purpose of the present invention, which will be described subsequently in greater detail, is to provide an improved mount for a firearm that has all the advantages of the prior art mentioned above.

To attain this, the preferred embodiment of the present invention essentially comprises a body having a first clamp configured to engage a first edge of the rail, a jaw movably connected to the body and having a second clamp opposed to the first clamp and operable with the respective clamps to engage respective opposed lateral edges of the rail, a spring biasing the jaw toward the body, and at least a portion of the spring being between the clamps. There may be a pushrod connected to a first one of the body and the jaw and slidably received by the other of the body and the jaw. The spring may be laterally positioned to one side of the pushrod. The spring may be a coil spring having a spring axis offset from a pushrod axis defined by the pushrod. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
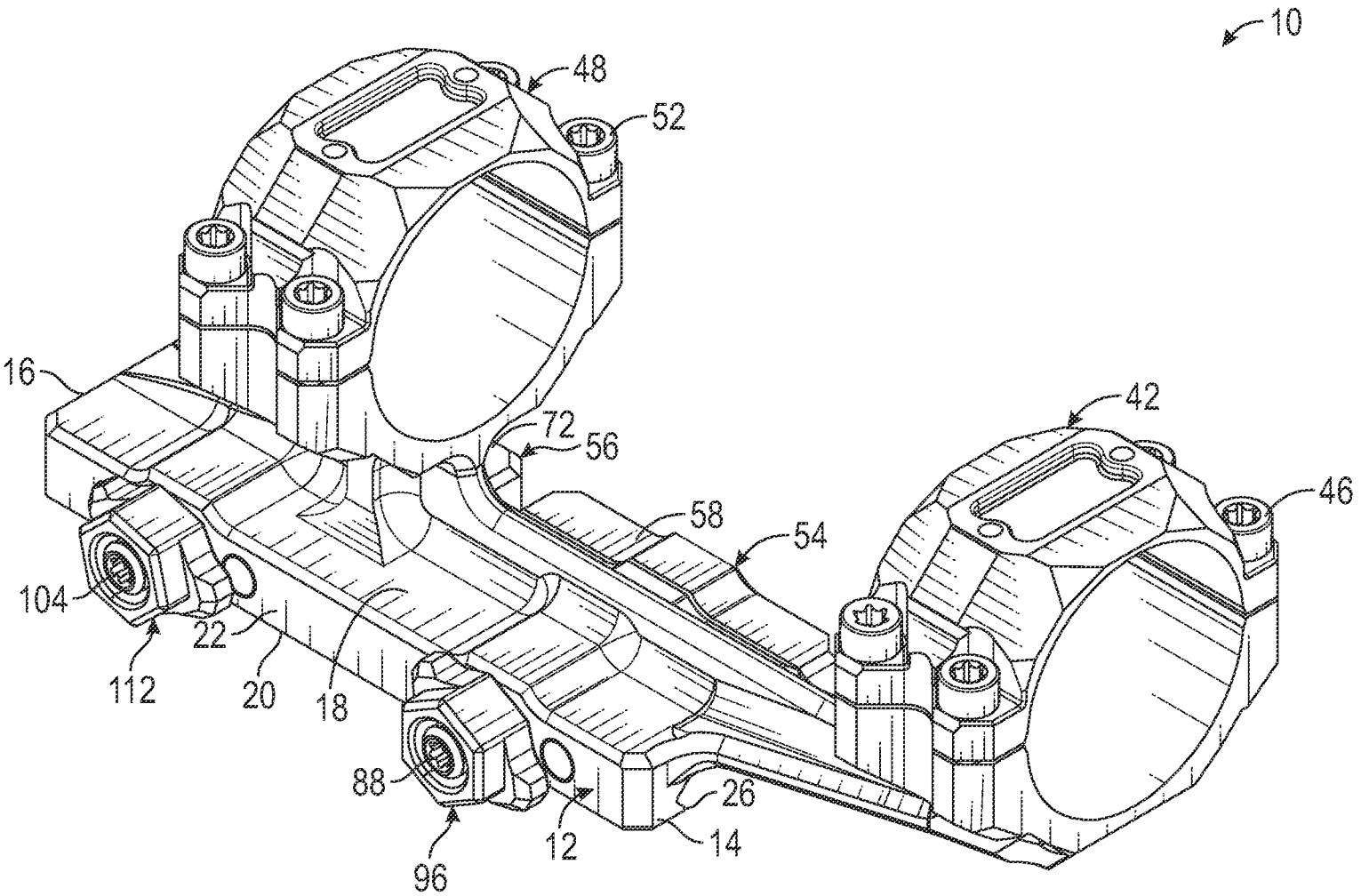
FIG. 1 is a top isometric view of the current embodiment of a mount for a firearm constructed in accordance with the principles of the present invention.

An embodiment of the mount for a firearm of the present invention is shown and generally designated by the reference numeral 10.

Figure 2:
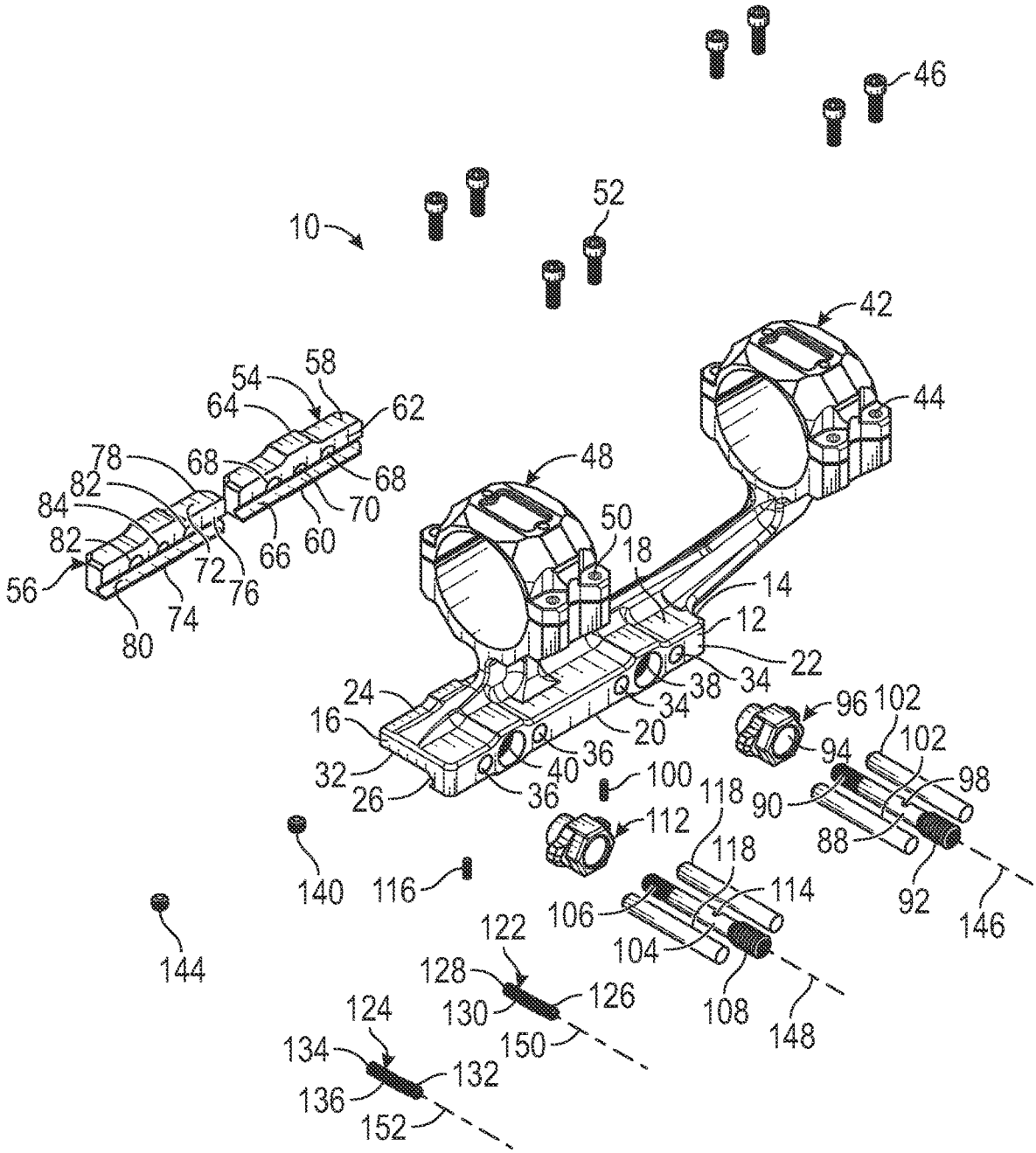
FIG. 2 is a top isometric exploded view of the mount for a firearm of FIG. 1.
Figure 3:
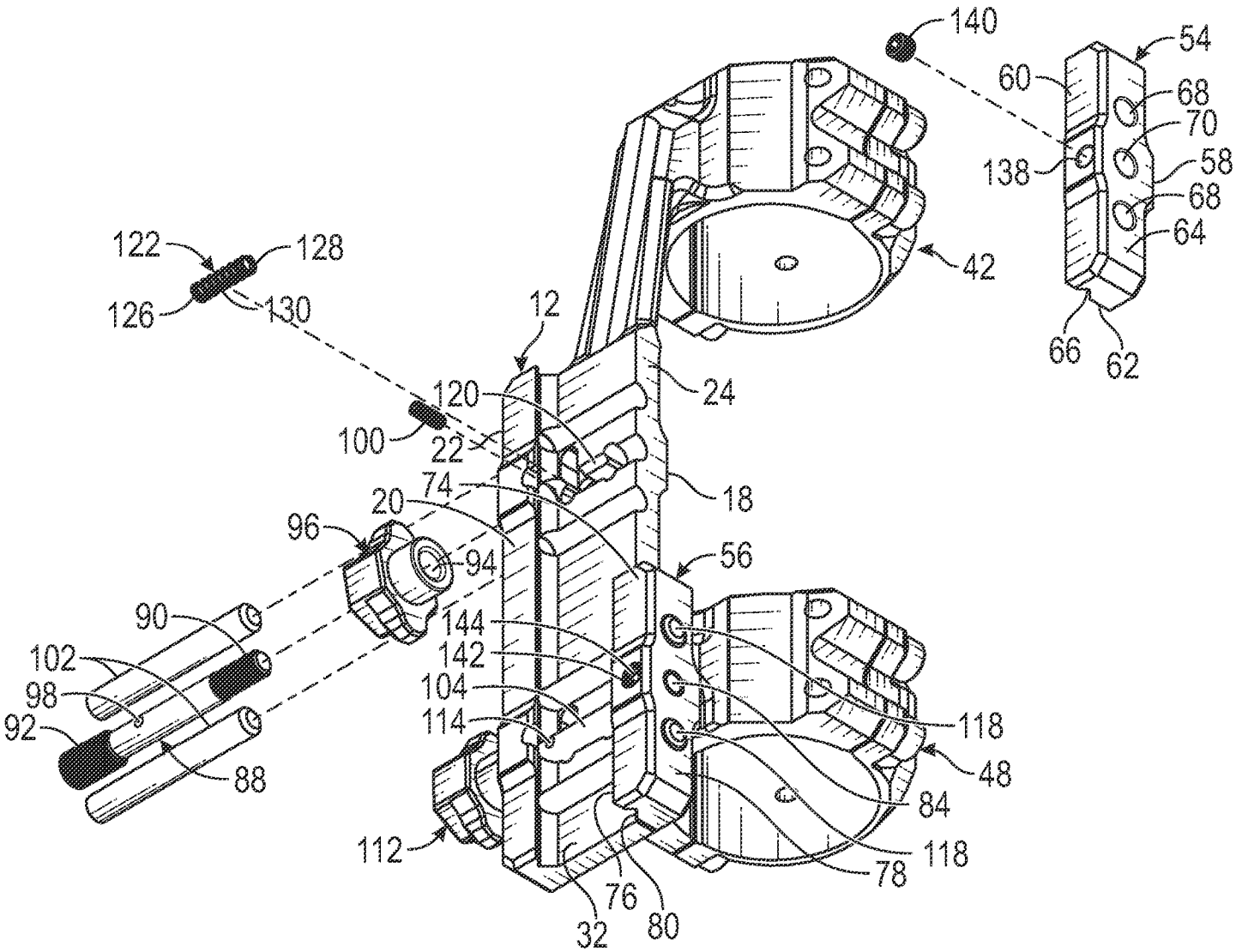
FIG. 3 is a bottom isometric partially exploded view of the mount for a firearm of FIG. 1.
Figure 4:
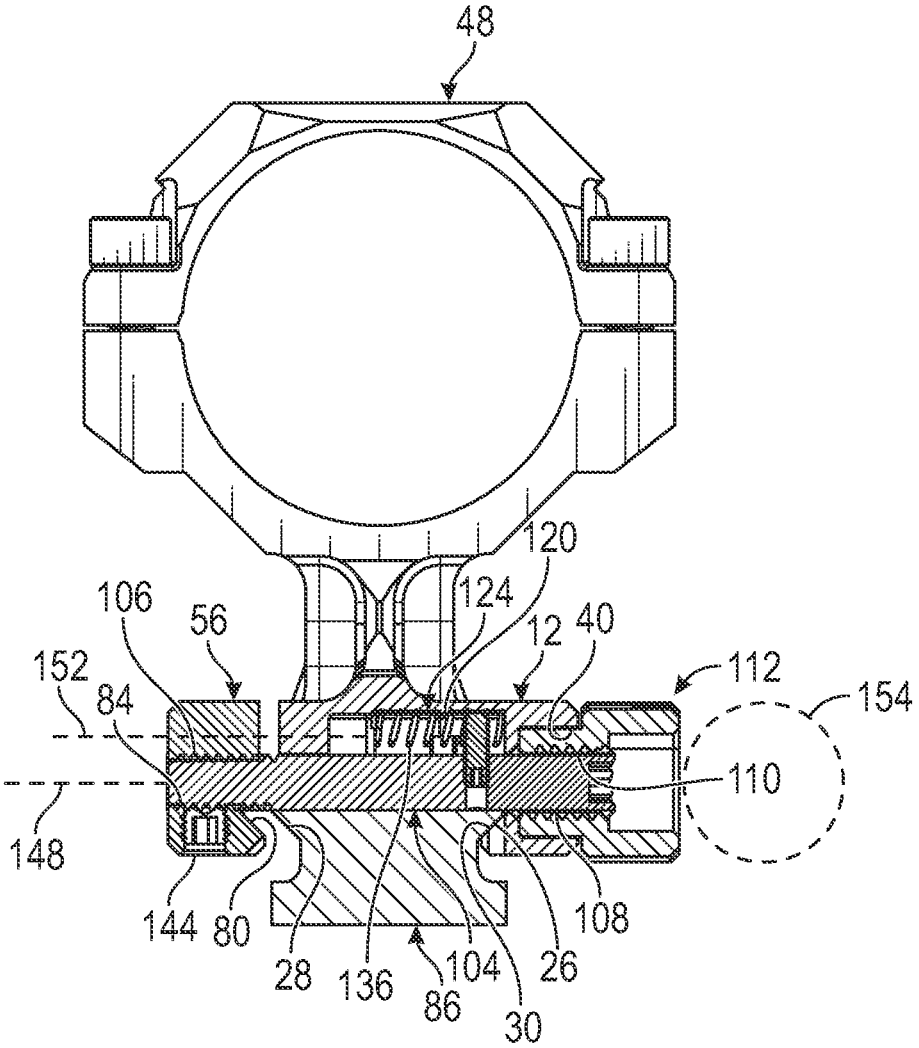
FIG. 4 is a front sectional view of the mount for a firearm of FIG. 1 in the process of being attached to a rail with the knob in the unlocked condition and depressed by a user's finger.
Figure 5:
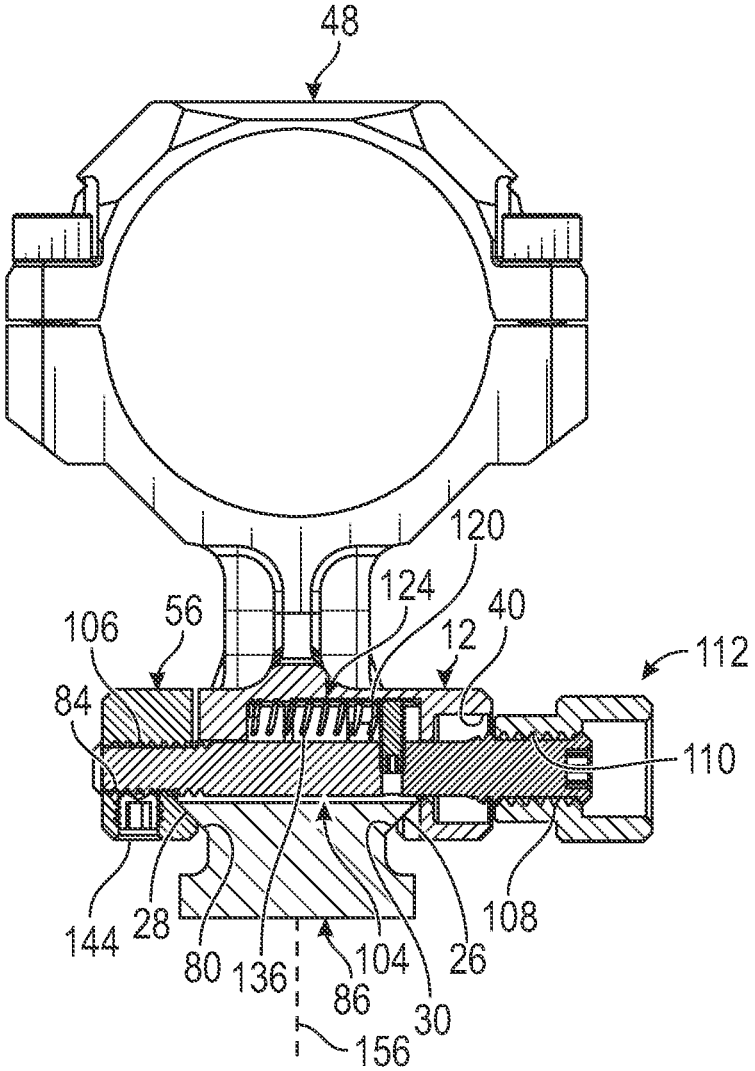
FIG. 5 is a front sectional view of the mount for a firearm of FIG. 1 attached to a rail with the knob in the unlocked condition.

FIGS. 1-3 illustrate the improved mount for a firearm 10 of the present invention. More particularly, the mount for a firearm has a body 12 having a front 14, rear 16, top 18, bottom 20, right side 22, and left side 24. The bottom right side of the body forms a first clamp 26 configured to engage a first edge 28 of a mounting rail 86 having opposed lateral edges (second edge 30 opposes the first edge). The mounting rail is depicted in FIGS. 4 and 5 and is shown in more detail in FIGS. 2 and 3 of the '307 patent discussed previously. The body defines a downward facing surface 32 configured to face an upper surface of the mounting rail. The right side of the body defines two pairs of guide pin apertures 34, 36 positioned on either side of two pushrod apertures 38, 40. The top front of the body has an attached front scope ring 42. The front scope ring includes four threaded bolt apertures 44 that threadedly receive four front scope ring bolts 46. The top of the body has an attached rear scope ring 48 positioned rearward of the front scope ring. The rear scope ring includes four threaded bolt apertures 50 that threadedly receive four rear scope ring bolts 52. The front and rear scope rings enable a scope (not shown) to be releasably secured to the mount for a firearm.

Front and rear jaws 54, 56 are removably connected to the left side 24 of the body 12. The front jaw has a top 58, bottom 60, right side 62, and left side 64. The right side of the front jaw defines a front second clamp 66 that is opposed to the first clamp 26. The front jaw also defines a pair of guide pin apertures 68 located on either side of a threaded pushrod aperture 70. The pair of guide pin apertures 68 are axially registered with the pair of guide pin apertures 34, and the threaded pushrod aperture 70 is axially registered with the pushrod aperture 38. The rear jaw has a top 72, bottom 74, right side 76, and left side 78. The right side of the rear jaw defines a rear second clamp 80 that is opposed to the first clamp 26. The rear jaw also defines a pair of guide pin apertures 82 located on either side of a threaded pushrod aperture 84. The pair of guide pin apertures 82 are axially registered with the pair of guide pin apertures 36, and the threaded pushrod aperture 84 is axially registered with the pushrod aperture 40. The front and rear jaws are operable with the respective first and second clamps to engage the respective opposed lateral edges 28, 30 of mounting rail 86 in a manner to be described subsequently.

A front pushrod 88 has a threaded portion 90 that is threadedly received in the threaded pushrod aperture 70 in the front jaw 54 and is slidably received within the pushrod aperture 38 in the body 12. The front pushrod has an enlarged threaded portion 92 that is received in a threaded aperture 94 in a front knob 96. The enlarged threaded portion is sufficiently large that the enlarged threaded portion cannot pass completely through the body when the front pushrod is inserted into the pushrod aperture 38. The front pushrod defines a lateral bore 98 located between the threaded portion and the enlarged threaded portion. The lateral bore receives a front lateral protrusion 100. A pair of front guide pins 102 are received in the pair of guide pin apertures 68 in the front jaw and the pair of guide pin apertures 34 in the body. The front guide pins ensure the front jaw can only move laterally with respect to the body as the front pushrod reciprocates within the pushrod aperture 38.

A rear pushrod 104 has a threaded portion 106 that is threadedly received in the threaded pushrod aperture 84 in the rear jaw 56 and is slidably received within the pushrod aperture 40 in the body 12. The rear pushrod has an enlarged threaded portion 108 that is received in a threaded aperture 110 in a front knob 112. The enlarged threaded portion is sufficiently large that the enlarged threaded portion cannot pass completely through the body when the rear pushrod is inserted into the pushrod aperture 40. The rear pushrod defines a lateral bore 114 located between the threaded portion and the enlarged threaded portion. The lateral bore receives a rear lateral protrusion 116. A pair of rear guide pins 118 are received in the pair of guide pin apertures 82 in the rear jaw and the pair of guide pin apertures 36 in the body. The rear guide pins ensure the rear jaw can only move laterally with respect to the body as the rear pushrod reciprocates within the pushrod aperture 40.

The body 12 defines front and rear elongated channels (rear elongated channel 120 is visible in FIGS. 3-6) located above the downward facing surface 32. A front spring 122 is received in the front elongated channel, and a rear spring 124 is received in the rear elongated channel. The front spring biases the front jaw 54 towards the body, and the rear spring biases the rear jaw 56 towards the body. The front spring is an elongated element having opposed right and left ends 126, 128 and an intermediate portion 130. At least a portion of the front spring is positioned between the first clamp 26 and front second clamp 66. The rear spring is an elongated element having opposed right and left ends 132, 134 and an intermediate portion 136. At least a portion of the rear spring is positioned between the first clamp and the rear second clamp 80.

When the front spring 122 is received in the front elongated channel, and the rear spring 124 is received in the rear elongated channel 120, the front spring is laterally positioned to one side of the front pushrod 88, and the rear spring is laterally positioned to one side of the rear pushrod 104. The front spring is biased against the front lateral protrusion 100, and the rear spring is biased against the rear lateral protrusion 116.

The bottom 60 of the front jaw 54 defines a threaded set screw aperture 138. A front set screw 140 is threadedly received in the threaded set screw aperture and contacts the threaded portion 90 of the front pushrod 88 to releasably secure the front pushrod within the threaded pushrod aperture 70 in the front jaw. The bottom 74 of the rear jaw 56 defines a threaded set screw aperture 142. A rear set screw 144 is threadedly received in the threaded set screw aperture and contacts the threaded portion 106 of the rear pushrod 104 to releasably secure the rear pushrod within the threaded pushrod aperture 84 in the rear jaw. The front pushrod defines a front pushrod axis 146, and the rear pushrod defines a rear pushrod axis 148. The front spring defines a front spring axis 150, and the rear spring defines a rear spring axis 152.

Figure 6:
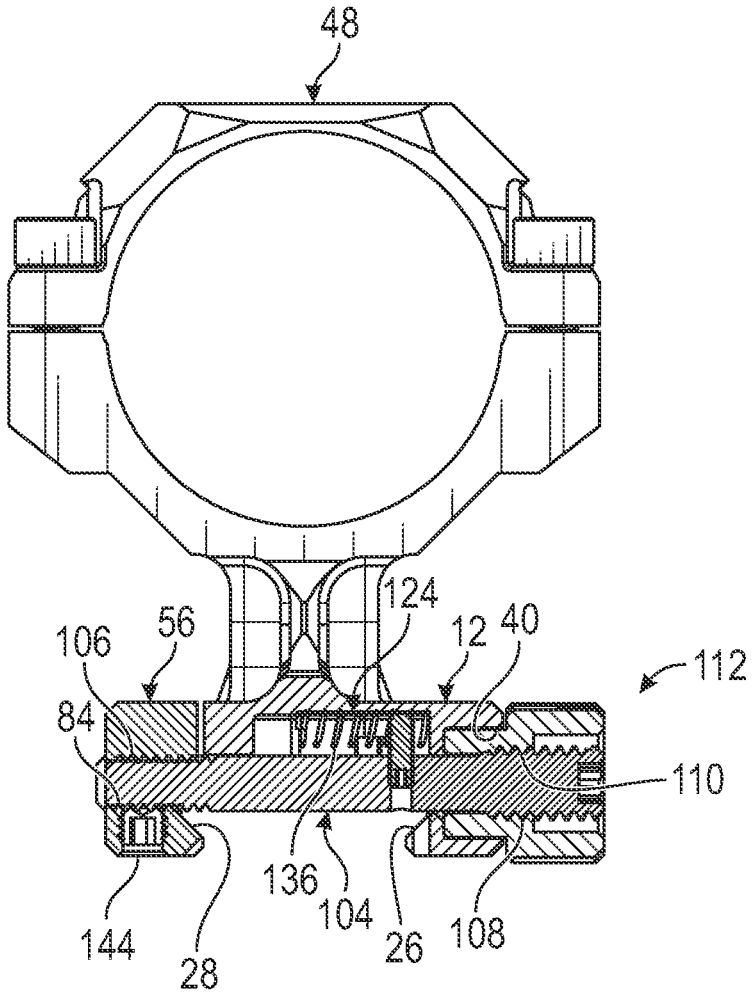
FIG. 6 is a front sectional view of the mount for a firearm of FIG. 1 attached to a rail with the knob in the locked condition.

FIGS. 4-6 illustrate the improved mount for a firearm 10 of the present invention. More particularly, the mount for a firearm is shown in FIG. 4 in the process of being attached to the mounting rail 86, in FIG. 5 attached to the mounting rail with the rear knob 112 in the unlocked position, and in FIG. 6 attached to the mounting rail with the rear knob in the locked position. In FIG. 4, a user's finger 154 has pushed the rear knob inward to compress the rear spring 124 and push the rear jaw 56 away from the body. In this position, sufficient space exists between the first clamp 26 and the rear second clamp 80 such that the opposed lateral edges 28, 30 of the mounting rail can be inserted between the first clamp and the rear second clamp. Once the opposed lateral edges of the mounting rail are inserted between the first clamp and the rear second clamp, the user releases the rear knob, and the rear spring pushes the rear knob away from the body to bring the rear second clamp into contact with the opposed lateral edge 30 to clamp the mounting rail between the first clamp and the rear second clamp. This condition is depicted in FIG. 5. The rear knob remains in the unlocked position in FIG. 5. The rear knob is subsequently tightened against the body 12 to place the rear knob in the locked condition in which the rear knob can no longer be pushed inward within the pushrod aperture 40 to dislodge the rear second clamp from the opposed lateral edge of the mounting rail. It should be appreciated that the front knob 96 and front jaw 54 function in exactly the same manner as the rear knob and rear jaw, and the above procedure is reversed to detach the mount for a firearm from the mounting rail.

The front and rear springs 122, 124 are coil springs in the current embodiment. The front spring axis 150 is offset from the front pushrod axis 146, and the rear spring axis 152 is offset from the rear pushrod axis 148. The front knob 86, which is threadedly engaged to the front pushrod 88 so as to be rotatable about the front pushrod, is operable to bias the first clamp 26 and the front second clamp 66 together to secure the mount for a firearm to the mounting rail when the front knob is tightened against the body 12. The rear knob 112, which is threadedly engaged to the rear pushrod 104 so as to be rotatable about the front pushrod, is operable to bias the first clamp 26 and the rear second clamp 80 together to secure the mount for a firearm to the mounting rail when the rear knob is tightened against the body. The front spring is located away from the front knob, does not contact the front knob, and the front knob directly contacts the body without the front spring intervening. The intermediate portion 130 of the front spring extends across a medial plane 156 defined by the first clamp and the front and rear second clamps when the clamps closely receive the mounting rail. The rear spring is located away from the rear knob, does not contact the rear knob, and the rear knob directly contacts the body without the rear spring intervening. The intermediate portion 136 of the rear spring extends across the medial plane defined by the first clamp and the front and rear second clamps when the clamps closely receive the mounting rail.

The mounting rail 86 is a conventional mounting rail of the type disclosed in FIGS. 2 and 3 of the '307 patent discussed previously. The mounting rail includes a plurality of mounting projections extending perpendicular along a longitudinal axis of the rail and separated by a plurality of transverse grooves spaced along the longitudinal axis of the rail, each of the mounting projections including an upper mounting surface and opposite transverse edges defining first and second inclined proximal surfaces on opposite sides of the upper mounting surface, a first inclined distal surface adjacent to said first inclined proximal surface, and a second inclined distal surface adjacent to said second inclined proximal surface. The body 12 can be viewed as a base including a first base member (the right side 22 of the body) and a second base member (front and rear jaws 54, 56), the first base member being linearly slidable into engagement with the second base member in a first direction, and the second base member being linearly slidable into engagement with the first base member in a second direction which is opposite the first direction. The first base member including a first clamping member (first clamp 26) assist for engaging a first edge of the mounting rail, and the second base member including a second clamping member (front and rear second clamps 66, 80) assist for engaging a second edge of the mounting rail which is opposite the first edge. The front and rear pushrods 88, 104 are members connecting the first base member to the second base member. A resilient member (front and rear springs 122, 124) operably engages each pushrod. The resilient member provides a spring force and is arranged to force the first clamping member to move in the first direction into locking engagement with the first edge of the mounting rail while simultaneously forcing the second clamping member to move in the second direction into locking engagement with the second edge of the mounting rail. At least a portion of the resilient member is positioned laterally between the first and second edges of the rail when the mount for a firearm 10, which is a mount adapter device for releasably attaching an accessory to a rail attached to a structure, is connected to the mounting rail.

It should be appreciated that the front guide pins 102 and front pushrod 88 are sized and spaced apart from each other such that they can be received in adjacent transverse grooves in the mounting rail and receive adjacent mounting projections between them. The rear guide pins 118 and rear pushrod 104 are sized and spaced apart from each other such that they can be received in adjacent transverse grooves in the mounting rail and receive adjacent mounting projections between them.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a mount for a firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A mount for a firearm having a mounting rail having opposed lateral edges, the mount comprising:

a body having a first clamp with a first lip configured to engage a first edge of the rail;

a jaw movably connected to the body and having a second clamp with a second lip opposed to the first clamp and operable with the respective clamps to engage respective opposed lateral edges of the rail;

a spring biasing the jaw toward the body; and at least a portion of the spring being between the first and second lips.

2. The mount of claim 1 including a pushrod connected to a first one of the body and the jaw and slidably received by the other of the body and the jaw.

3. The mount of claim 2 wherein the spring is laterally positioned to one side of the pushrod.

4. The mount of claim 2 wherein the spring is a coil spring having a spring axis offset from a pushrod axis defined by the pushrod.

5. The mount of claim 2 including a knob threadedly engaged to the pushrod and operable to bias the clamps together to secure the mount to the rail.

6. The mount of claim 5 wherein the knob directly contacts the body without the spring intervening.

7. The mount of claim 5 wherein the spring is away from the knob.

8. The mount of claim 5 wherein the spring does not contact the knob.

9. The mount of claim 2 wherein the pushrod included a lateral protrusion and wherein the spring is biased against the lateral protrusion.

10. The mount of claim 1 wherein the spring is an elongated element having opposed ends, and an intermediate portion extending across a medial plane defined by the clamps when closely receiving the rail.

11. The mount of claim 1 wherein the body defines a downward facing surface configured to face an upper surface of the rail, and wherein the body defines an elongated channel above the downward facing surface, and wherein the spring is received in the channel.

12. A mount for a firearm having a mounting rail having opposed lateral edges, the mount comprising:

a body having a first clamp configured to engage a first edge of the rail;

a jaw movably connected to the body and having a second clamp opposed to the first clamp and operable with the respective clamps to engage respective opposed lateral edges of the rail;

a spring biasing the jaw toward the body;

at least a portion of the spring being between the clamps;

a pushrod connected to a first one of the body and the jaw and slidably received by the other of the body and the jaw; and wherein the spring is laterally positioned to one side of the pushrod.

13. A mount for a firearm having a mounting rail having opposed lateral edges, the mount comprising:

a body having a first clamp configured to engage a first edge of the rail;

a jaw movably connected to the body and having a second clamp opposed to the first clamp and operable with the respective clamps to engage respective opposed lateral edges of the rail;

a spring biasing the jaw toward the body;

at least a portion of the spring being between the clamps;

a pushrod connected to a first one of the body and the jaw and slidably received by the other of the body and the jaw; and wherein the spring is a coil spring having a spring axis offset from a pushrod axis defined by the pushrod.

14. A mount for a firearm having a mounting rail having opposed lateral edges, the mount comprising:

a body having a first clamp configured to engage a first edge of the rail;

a jaw movably connected to the body and having a second clamp opposed to the first clamp and operable with the respective clamps to engage respective opposed lateral edges of the rail;

a spring biasing the jaw toward the body;

at least a portion of the spring being between the clamps;

a pushrod connected to a first one of the body and the jaw and slidably received by the other of the body and the jaw;

a knob threadedly engaged to the pushrod and operable to bias the clamps together to secure the mount to the rail; and wherein the knob directly contacts the body without the spring intervening.

15. A mount for a firearm having a mounting rail having opposed lateral edges, the mount comprising:

a body having a first clamp configured to engage a first edge of the rail;

a jaw movably connected to the body and having a second clamp opposed to the first clamp and operable with the respective clamps to engage respective opposed lateral edges of the rail;

a spring biasing the jaw toward the body;

at least a portion of the spring being between the clamps;

a pushrod connected to a first one of the body and the jaw and slidably received by the other of the body and the jaw;

a knob threadedly engaged to the pushrod and operable to bias the clamps together to secure the mount to the rail; and wherein the spring is away from the knob.

16. A mount for a firearm having a mounting rail having opposed lateral edges, the mount comprising:

a body having a first clamp configured to engage a first edge of the rail;

a jaw movably connected to the body and having a second clamp opposed to the first clamp and operable with the respective clamps to engage respective opposed lateral edges of the rail;

a spring biasing the jaw toward the body;

at least a portion of the spring being between the clamps;

a pushrod connected to a first one of the body and the jaw and slidably received by the other of the body and the jaw;

a knob threadedly engaged to the pushrod and operable to bias the clamps together to secure the mount to the rail; and wherein the spring does not contact the knob.

17. A mount for a firearm having a mounting rail having opposed lateral edges, the mount comprising:

a body having a first clamp configured to engage a first edge of the rail;

a jaw movably connected to the body and having a second clamp opposed to the first clamp and operable with the respective clamps to engage respective opposed lateral edges of the rail;

a spring biasing the jaw toward the body;

at least a portion of the spring being between the clamps;

a pushrod connected to a first one of the body and the jaw and slidably received by the other of the body and the jaw; and wherein the pushrod included a lateral protrusion and wherein the spring is biased against the lateral protrusion.

18. A mount for a firearm having a mounting rail having opposed lateral edges, the mount comprising:

a body having a first clamp configured to engage a first edge of the rail;

a jaw movably connected to the body and having a second clamp opposed to the first clamp and operable with the respective clamps to engage respective opposed lateral edges of the rail;

a spring biasing the jaw toward the body;

at least a portion of the spring being between the clamps; and wherein the spring is an elongated element having opposed ends, and an intermediate portion extending across a medial plane defined by the clamps when closely receiving the rail.

* * * * *